US005407127A

United States Patent [19]

Worden

[11] Patent Number: 5,407,127

[45] Date of Patent: Apr. 18, 1995

[54] MAIL, NEWSPAPER, AND PARCEL DELIVERY SYSTEM

[76] Inventor: Thomas C. Worden, 4608 Wye Way La. SW., Knoxville, Tenn. 37920

[21] Appl. No.: 71,542

[22] Filed: Jun. 4, 1993

[51] Int. Cl.[6] ..... B65D 91/00

[52] U.S. Cl. ..... 232/17; 232/24

[58] Field of Search ..... 232/17, 24, 29, 30, 232/31, 33, 38, 39

[56] References Cited

U.S. PATENT DOCUMENTS

| | | | |
|---|---|---|---|
| D. 254,635 | 4/1980 | Earle . | |
| D. 324,444 | 3/1992 | Cummings . | |
| 379,302 | 3/1888 | Archer | 232/24 |
| 479,576 | 7/1892 | Spear | 232/24 |
| 1,124,817 | 6/1915 | Scott | 232/24 |
| 1,137,740 | 5/1915 | Challeen | 232/24 |
| 1,579,665 | 4/1926 | Sherry | 232/17 |
| 2,142,901 | 1/1939 | Kellam | 232/17 |
| 2,194,900 | 3/1940 | Helten . | |
| 2,267,072 | 12/1941 | Beggs . | |
| 2,452,667 | 11/1948 | Lambert | 232/17 |
| 2,527,601 | 10/1950 | Turnidge . | |
| 2,945,621 | 7/1960 | Kopprasch | 232/24 |
| 3,107,848 | 10/1963 | Penta | 232/17 |
| 4,333,609 | 6/1982 | Carlson | 232/24 |
| 4,602,721 | 7/1986 | Hicks . | |
| 4,848,650 | 7/1989 | Roberts, II . | |

FOREIGN PATENT DOCUMENTS

| | | | |
|---|---|---|---|
| 463060 | 2/1950 | Canada | 232/17 |

*Primary Examiner*—Flemming Saether
*Attorney, Agent, or Firm*—Pitts & Brittian

[57] ABSTRACT

A mail and parcel delivery system (10) for receiving postal service mail delivered, and to be delivered, by a governmental postal authority and for receiving direct delivery items and packages. The delivery system (10) includes a postal service mail receptacle (26) for receiving postal service mail, and a housing (12) defining a mail receptacle compartment (24) for receiving and housing the postal service mail receptacle (26). The housing (12) also defines a direct delivery compartment (58) for receiving direct delivery items and a package delivery compartment (76) for receiving large packages. In one embodiment the delivery system (10') includes an incoming mail receptacle (26') and an outgoing mail receptacle (98), both housed in the mail receptacle compartment (24').

11 Claims, 9 Drawing Sheets

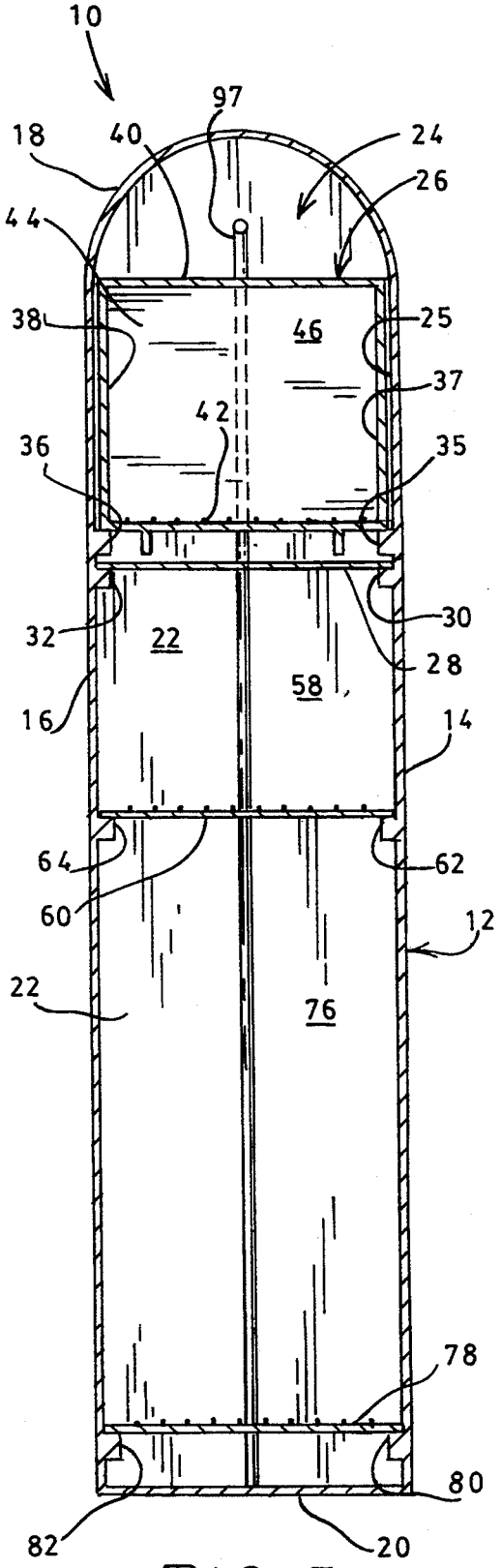
FIG. 5
FIG. 6
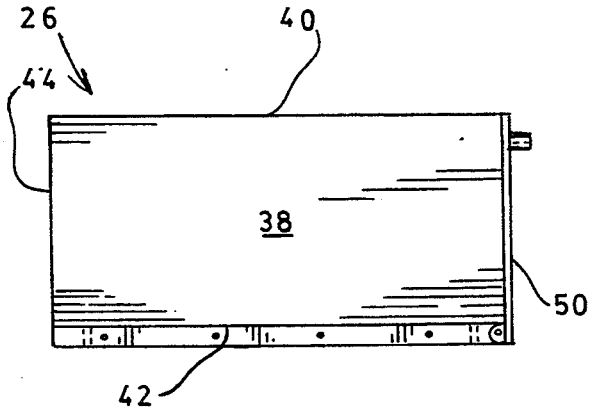
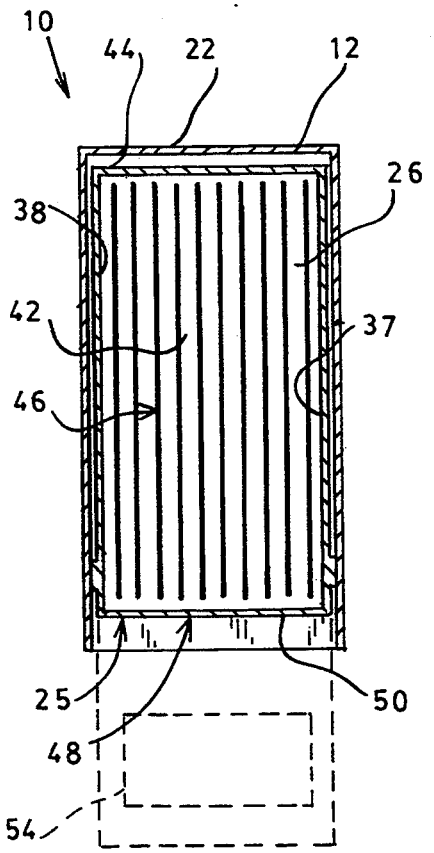
FIG. 7

MAIL, NEWSPAPER, AND PARCEL DELIVERY SYSTEM

TECHNICAL FIELD

This invention relates a mail, newspaper and parcel delivery system for receiving postal service mail delivered, or to be delivered, by the United States Postal Service or other governmental postal authority, and for receiving direct delivery items and packages. In this particular invention the delivery system includes a housing defining a mail receptacle compartment, a direct delivery compartment, and a package delivery compartment.

BACKGROUND ART

It has long been the practice in the United States for the Postal Service to deliver mail to curbside receptacles or mailboxes and to pick up mail which is to be delivered from such receptacles. In order to facilitate the efficient delivery, collection, and protection of mail, the United States Postal Service has enacted regulations which prohibit items other than postal service mail delivered by, or to be collected by, the Postal Service from being placed in such receptacles or mailboxes. This notwithstanding, direct delivery items such as newspapers, magazines, circulars, notices, packages and the like, are often improperly placed in mailboxes. This misuse of mailboxes generally occurs because mailboxes offer a convenient receptacle for receiving such delivered items, and often delivery to the mailbox obviates the necessity of taking a directly delivered item to the door of a residence or office.

A partial solution to this problem has come as a result of the use of curbside newspaper receptacles which avoid the improper use of the mailbox to hold newspapers. Whereas newspaper receptacles are useful in accommodating the delivery of newspapers, they can be unsuitable receptacles for receiving other direct delivery items such as packages. Moreover, newspaper distributors discourage the use of newspaper receptacles for other purposes such that the receptacles will remain free to receive their newspapers.

Certain other receptacles devised in an effort to solve problems associated with the delivery of postal service mail and direct delivery items are disclosed in U.S. Pat. Nos. Des. 324,444; 4,848,650; 4,602,721; 2,267,072; and 2,194,900. However, such devices fail to provide a comprehensive and efficient delivery system within U.S. Postal Service specifications to accommodate the delivery of postal service mail and various direct delivery items.

Therefore, it is an object of the present invention to provide a delivery system for receiving postal service mail delivered, and to be delivered, by the United States Postal Service or other governmental postal authority, and for receiving direct delivery items and packages.

It is another object of the present invention to provide a delivery system which is readily positioned at a curbside location.

Yet another object of the present invention is to provide a delivery system which reduces the time necessary for postal service employees to deliver mail, and obviates the improper use of the postal service mail receptacle.

Still another object of the present invention is to provide a delivery system which provides separate receptacles for incoming and outgoing mail to facilitate the efficient delivery and collection and increased security of mail.

Another object of the present invention is to provide a delivery system which can be manufactured and maintained at low cost.

DISCLOSURE OF THE INVENTION

Other objects and advantages will be accomplished by the present invention which provides a mail, newspaper and parcel delivery system for receiving postal service mail delivered, and to be delivered, by the U.S. Postal Service or other governmental postal authority and for receiving direct delivery items and packages. The delivery system includes a housing defining a mail receptacle compartment for receiving and housing a mail receptacle. The postal service mail receptacle serves to receive postal service mail which is either delivered by the postal service or mail which is to be picked up for mailing by the postal service. The housing of the delivery system also defines a direct delivery compartment for receiving direct delivery items, and defines a package delivery compartment for receiving large packages. In one embodiment the delivery system includes an incoming mail receptacle and an outgoing mail receptacle, both housed in the mail receptacle compartment of the housing.

BRIEF DESCRIPTION OF THE DRAWINGS

The above mentioned features of the invention will be more clearly understood from the following detailed description of the invention read together with the drawings in which:

FIG. 5 illustrates a front elevation view, in section, of a mail, newspaper and parcel delivery system of the present invention.

FIG. 6 illustrates a side elevation view of the postal service mail receptacle of a mail, newspaper and parcel delivery system of the present invention.

FIG. 7 illustrates a top plan view, in section taken at 7—7 of FIG. 2, of the postal service mail receptacle of a mail, newspaper and parcel delivery system of the present invention.

BEST MODE FOR CARRYING OUT THE INVENTION

Figure 1:
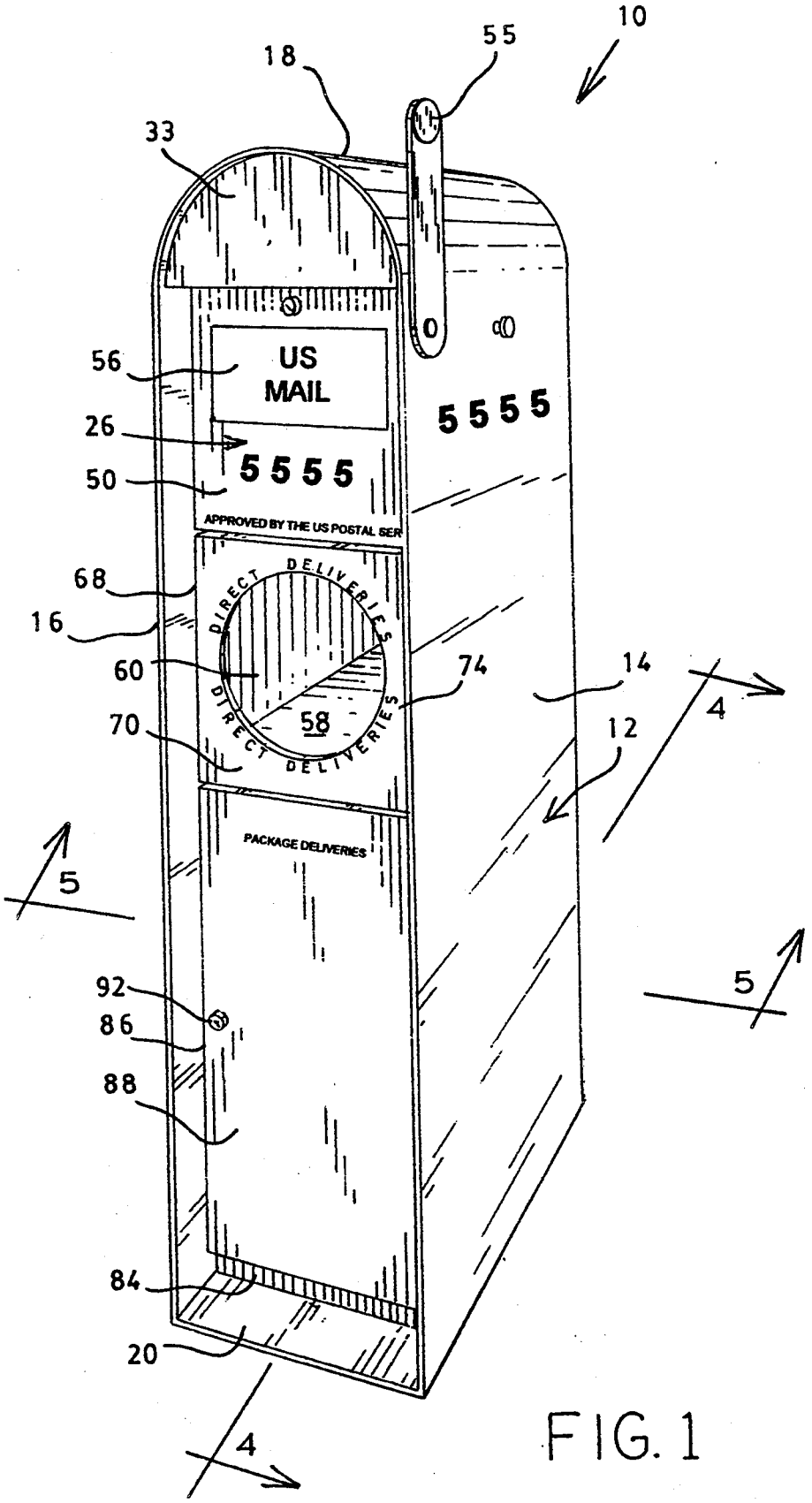
FIG. 1 illustrates a perspective view of a mail, newspaper and parcel delivery system of the present invention.
Figure 2:
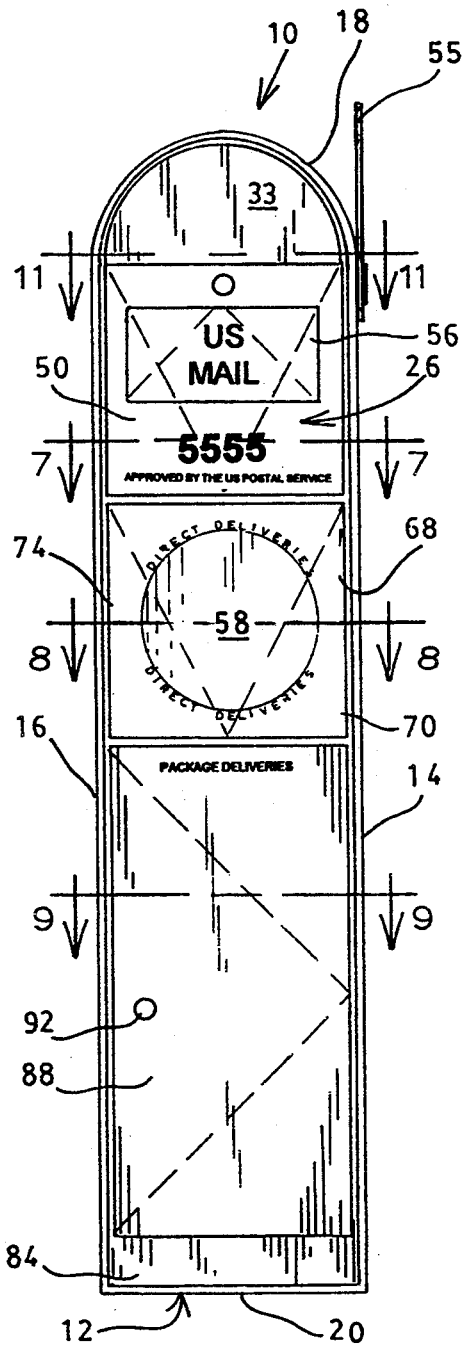
FIG. 2 illustrates a front elevation view of a mail, newspaper and parcel delivery system of the present invention.

A mail, newspaper and parcel delivery system incorporating various features of the present invention is illustrated generally at 10 in the Figures. In the preferred illustrated embodiment the delivery system 10 includes an outer housing 12 having first and second sidewalls 14 and 16, respectively, top and bottom walls 18 and 20, respectively, and a rear wall 22. It will be noted that the delivery system 10 is preferably provided with an arcuate top wall 18 such that rain or other precipitation will not collect on the top wall 18, but other top wall configurations can be utilized if desired.

As best illustrated in FIGS. 4 through 7, the upper portion of the housing 12 defines a mail receptacle compartment 24 for housing a postal service mail receptacle 26, the compartment 24 defining an opening 25 through which the mail receptacle 26 is received. The receptacle compartment 24 is defined by the upper portion of the sidewalls 14 and 16, the upper portion of the rear wall 22, the top wall 18, and a first partition 28 which extends between the sidewalls 14 and 16. More specifically, the partition 28 is supported by oppositely disposed support rails 30 and 32, provided on the sidewalls 14 and 16, respectively, and by a cross support member 34 which extends between the sidewalls 14 and 16.

It will be understood that the receptacle 26 is intended to receive mail deliveries from the United States Postal Service, or other governmental postal authority, and receives outgoing mail to be picked up and delivered by such postal authority. The postal service mail receptacle 26 is supported within the compartment 24 by oppositely disposed support rails 35 and 36, provided on the sidewalls 14 and 16, respectively. Also, a cross brace member 31, which extends between the sidewalls 14 and 16, is provided to help retain the receptacle 26 in the desire position within the receptacle compartment 24. It will be noted that in the preferred embodiment the cross brace member 31 carries an upwardly extending panel 33 which serves to enclose the portion of the opening 25 above the mail receptacle 26.

The postal service mail receptacle 26 includes opposite sidewalls 37 and 38, top and bottom walls 40 and 42, respectively, and a rear wall 44, which cooperatively define a postal service mail compartment 46. The postal service mail compartment 46 is accessed through an primary opening 48, and is provided with a primary closure 50 which is pivotally secured to the receptacle 26 with a suitable hinge mechanism 52 such that it can selectively pivoted to cover the opening 48. In the preferred illustrated embodiment, the primary closure 50 defines a secondary opening 54 and is provided with a secondary closure 56 for selectively covering the secondary opening 54. The secondary closure 56 is pivotally secured proximate its upper edge to the primary closure 50 such that the secondary closure 56 pivots inwardly to provide access to the postal service mail compartment 46.

With respect to the use of the receptacle 26, it will be appreciated that the secondary opening 54 can be used to insert letters and the like into the compartment 46, such that it is not necessary to open the primary closure 50 (except for mail collection). By obviating the need for the postal employee to open and close the primary closure 50 upon delivering mail to the mail receptacle, the fast and efficient delivery of mail is facilitated. Of course, the primary closure 50 can be opened when necessary to remove mail from the compartment 40, or when necessary to insert mail which cannot be inserted through the secondary opening 54.

Figure 3:
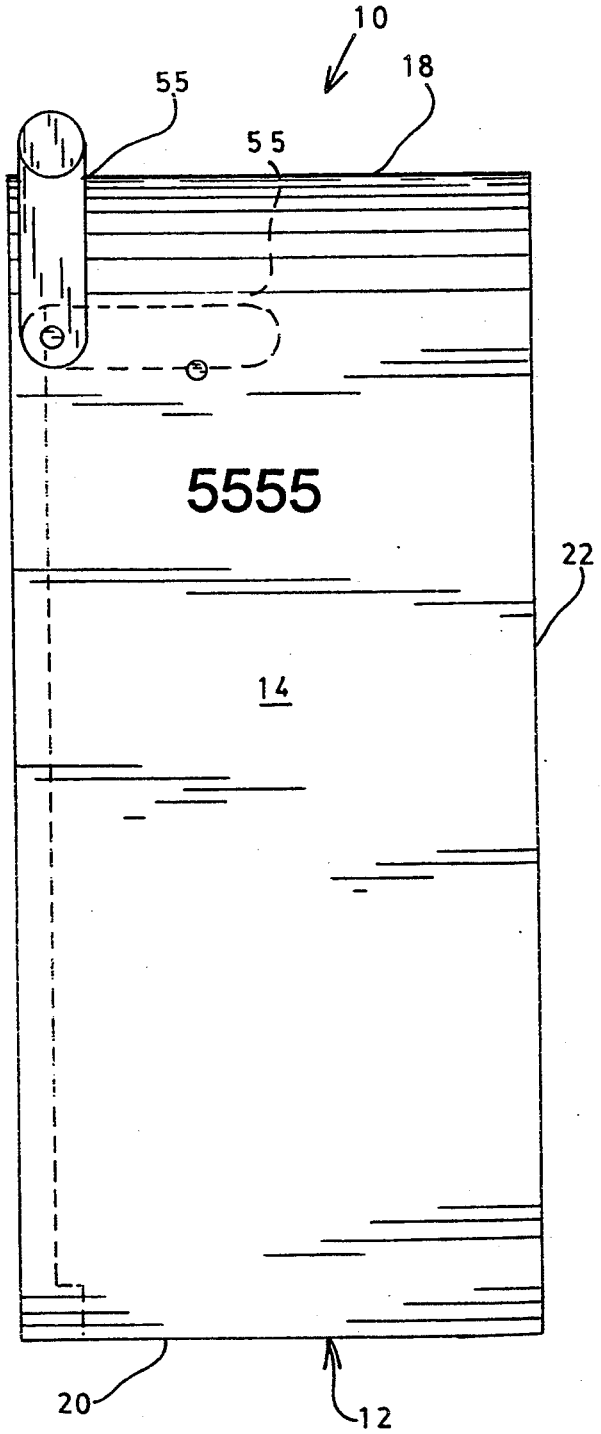
FIG. 3 illustrates a right side elevation view of a mail, newspaper and parcel delivery system of the present invention.

It will also be noted that a flag member 55 is pivotally secured to the side of the housing 12, the flag member 55 being pivotable from a lowered position referenced by broken lines in FIG. 3 to a raised position referenced by continuous lines in FIG. 3. It will be recognized that the positioning of the flag 55 in the raised position signals that the receptacle 26 contains outgoing mail to be picked up by a postal employee.

The delivery system be also provides a direct delivery compartment 58 for receiving delivered items other than those delivered by the governmental postal authority, such as newspapers, magazines, circulars, notices and the like. The direct delivery compartment 58 is defined by a portion of the sidewalls 14 and 16, a portion of the rear wall 22, the partition 28, and a further partition 60 which extends between the sidewalls 14 and 16. The partition 60 is supported by oppositely disposed support rails 62 and 64, provided on the sidewalls 14 and 16, respectively, and by a cross support member 66 which extends between the sidewalls 14 and 16.

The direct delivery compartment 58 is accessed through an primary opening 68, and is provided with a closure 70 which is pivotally secured to the cross support member 66 with a suitable hinge mechanism 72 such that it can selectively pivoted to cover the opening 68. It will be noted that in the preferred embodiment, oppositely disposed side braces 73 and 75 are secured to, and extend vertically along a selected portion of the interior of, the sidewalls 14 and 16. As a result, the primary opening 68 is defined by the cross support members 34 and 66, and the side braces 73 and 75.

In the preferred illustrated embodiment, the closure 70 defines a secondary opening 74 through which direct delivery items can be inserted into the direct delivery compartment 58. Of course, the closure 70 can be opened to facilitate removal of items from the compartment 58 or to facilitate the insertion of items which cannot be received through the secondary opening 74.

In the preferred illustrated embodiment of the delivery system 10, a package delivery compartment 76 is provided in the lower portion of the housing 12. The package delivery compartment 76 is designed to receive large packages which cannot be accommodated by the direct delivery compartment 58. The package delivery compartment 76 is defined by the lower portion of the sidewalls 14 and 16, the lower portion of the rear wall 22, the further partition 60, and a lower partition 78 which extends between the sidewalls 14 and 16. The partition 78 is supported by oppositely disposed support rails 80 and 82, provided on the sidewalls 14 and 16, respectively, and by a cross support member 84 which extends between the sidewalls 14 and 16.

Figure 9:
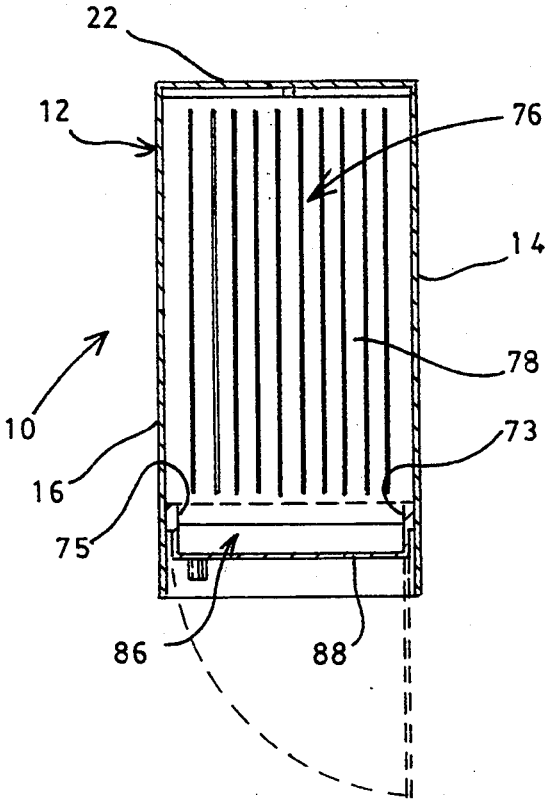
FIG. 9 illustrates a top plan view, in section taken at 9—9 of FIG. 2, of the package delivery compartment of a mail, newspaper and parcel delivery system of the present invention.
Figure 10:
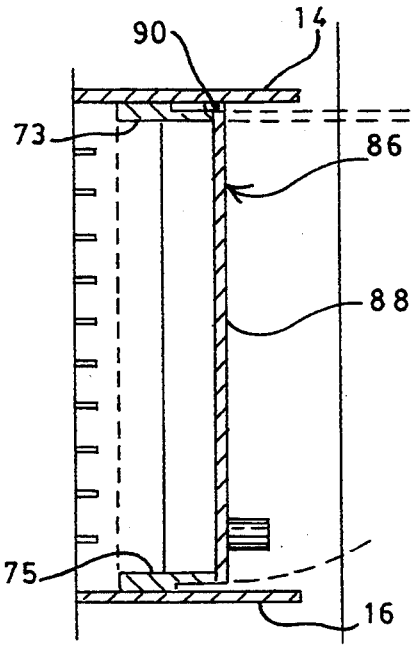
FIG. 10 illustrates a partial top plan view, in section taken at 9—9 of FIG. 2, of the package delivery compartment of a mail, newspaper and parcel delivery system of the present invention.

As best illustrated in FIGS. 9 and 10, the package delivery compartment 76 is accessed through an opening 86 and is provided with a closure 88 for selectively covering the opening 86. More specifically, the opening 86 is defined by the cross support members 66 and 84, and the side braces 73 and 75, and the closure 88 is pivotally secured to the side brace 73 with a suitable hinge mechanism 90. Further, a handle means, such as the knob 92 can be provided to facilitate the opening and closing of the closure 88.

Figure 4:
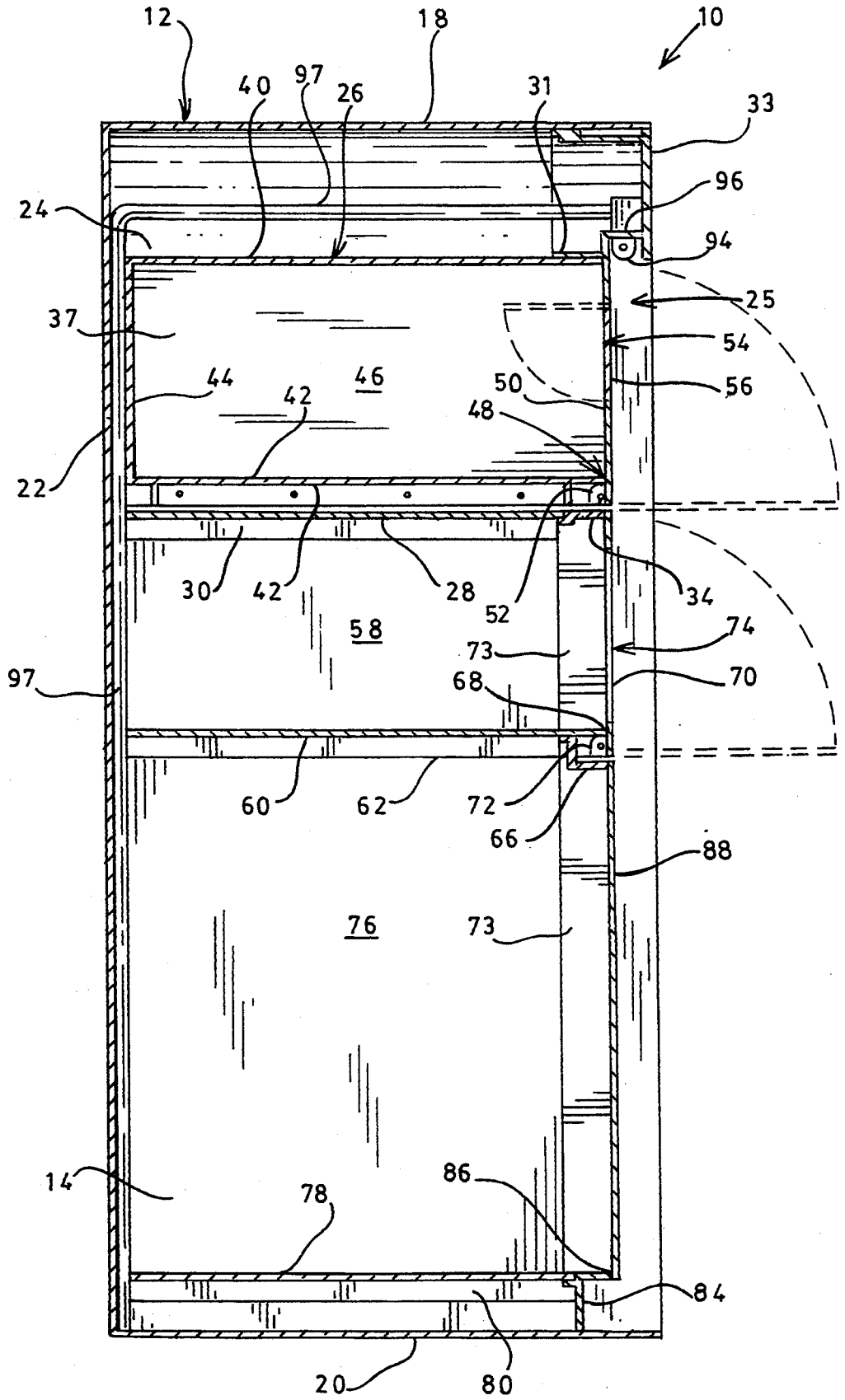
FIG. 4 illustrates a left side elevation view, in section, of a mail, newspaper and parcel delivery system of the present invention.
Figure 8:
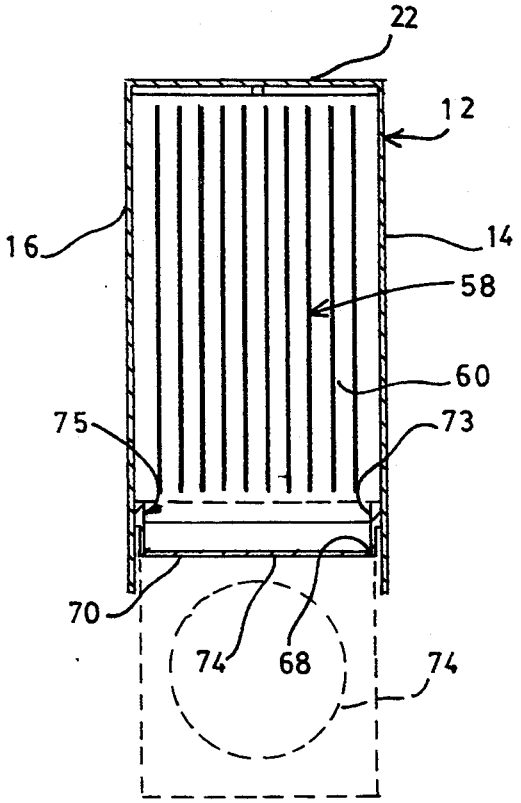
FIG. 8 illustrates a top plan view, in section taken at 8—8 of FIG. 2, of the direct delivery compartment of a mail, newspaper and parcel delivery system of the present invention.
Figure 11:
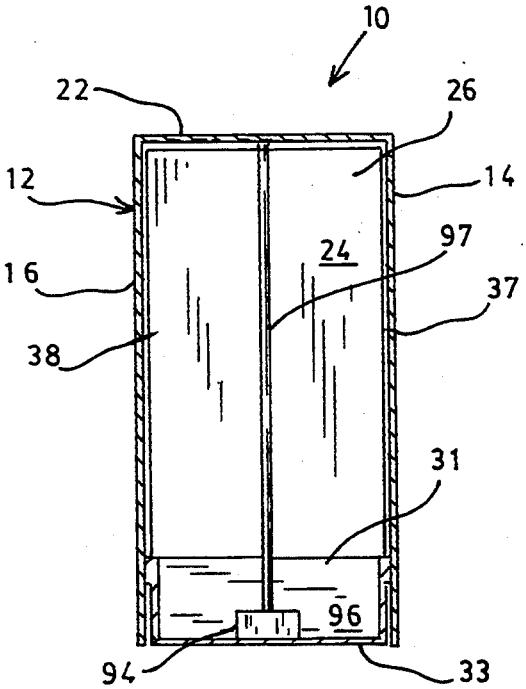
FIG. 11 illustrates a top plan view, in section taken at 11—11 of FIG. 2, of the mail receptacle compartment of a mail, newspaper and parcel delivery system of the present invention.

As best illustrated in FIGS. 4 and 11, in the preferred embodiment of the delivery system be, a light fixture is provided for receiving a light bulb and illuminating the front portion of the housing 12 so as to facilitate use of the system at night. In this regard, in the illustrated embodiment the cross brace member 33 defines an outwardly extending portion 96 in which the light fixture is mounted, such that a light bulb secured in the fixture is disposed forward the closures 50, 56, 70 and 88, and serves to illuminate such closures and any house number or other address indicia printed thereon. A wiring conduit 97 can also be provided to facilitate the routing of the necessary electrical wiring to the fixture 94.

Figure 12:
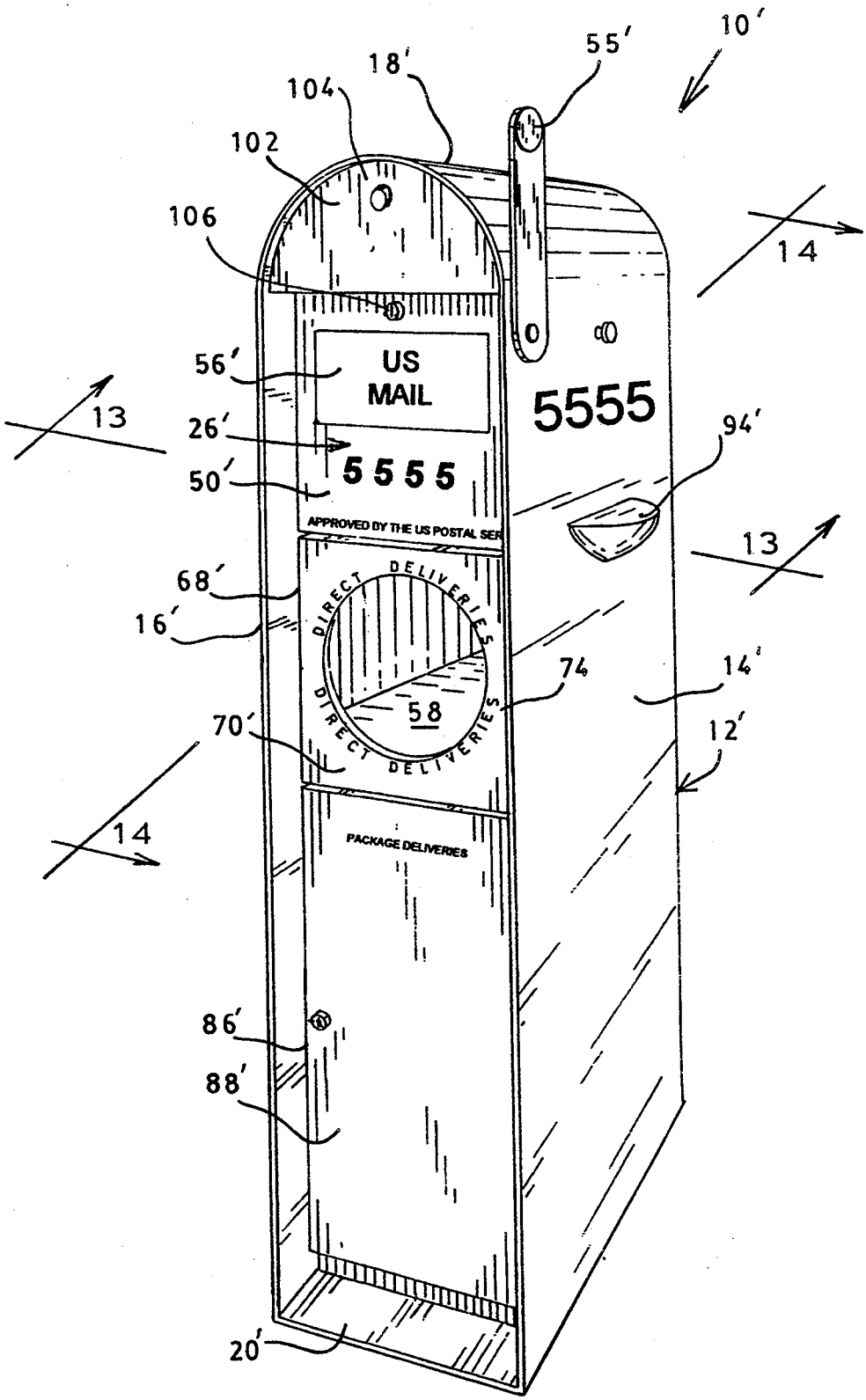
FIG. 12 illustrates a perspective view of an alternate embodiment of a mail, newspaper and parcel delivery system of the present invention.
Figure 13:
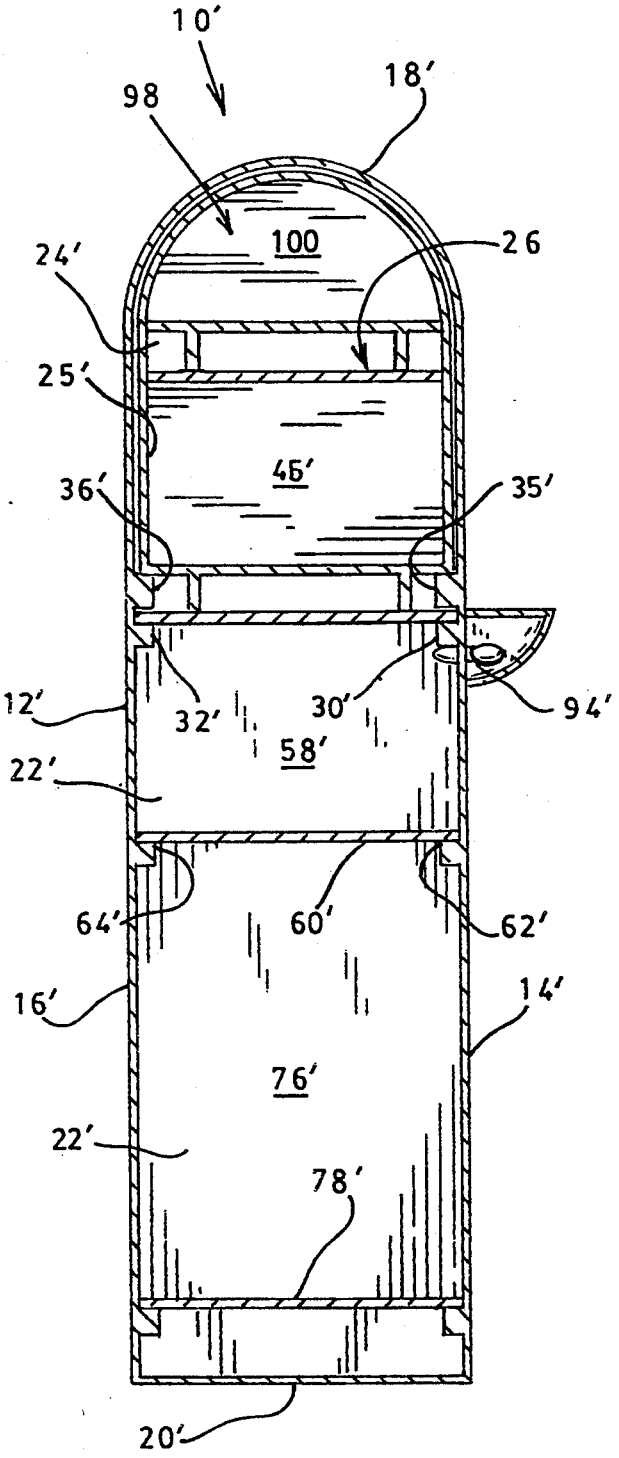
FIG. 13 illustrates a front elevation view, in section, of an alternate embodiment of a mail, newspaper and parcel delivery system of the present invention.
Figure 14:
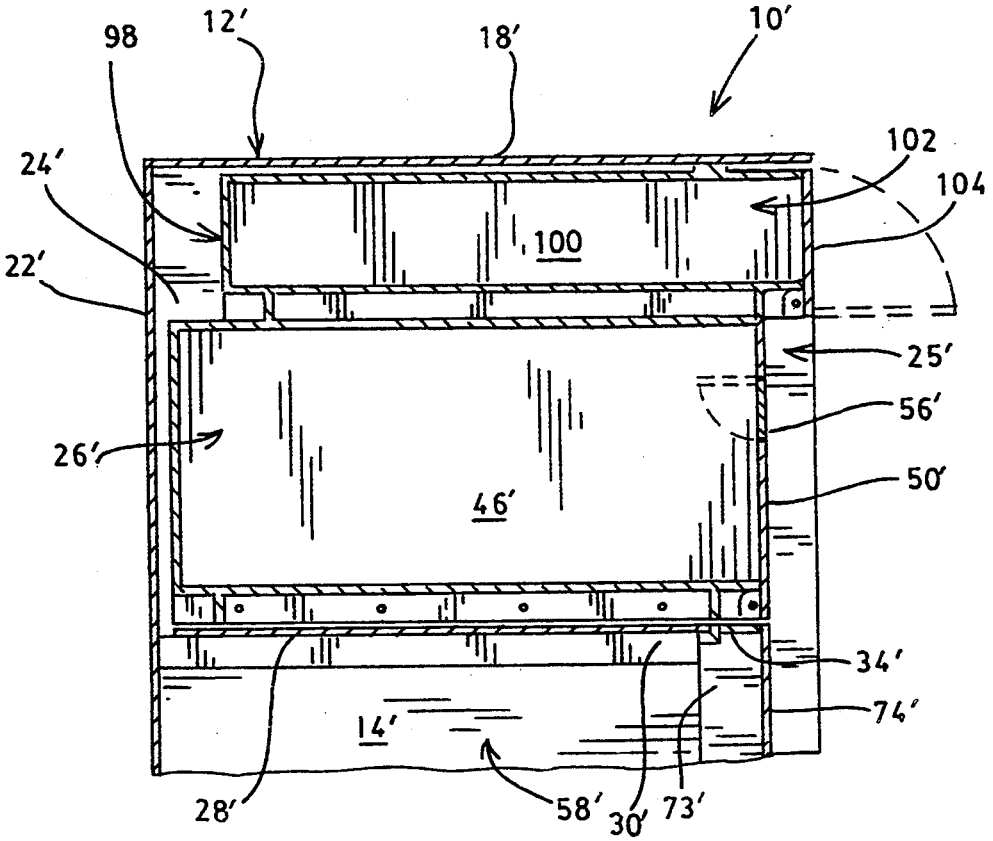
FIG. 14 illustrates a partial left side elevation view, in section, of an alternate embodiment of a mail, newspaper and parcel delivery system of the present invention.

In FIGS. 12, 13 and 14, an alternate embodiment of the delivery system of the present invention is illustrated at 10'. For convenience, components of the delivery system 10' which are common to those of the above described delivery system 10 are referenced in the Figures with common prime numerals.

In the preferred embodiment of the system 10' an outgoing postal service mail receptacle 98 is provided which defines a mail collection compartment 100 for receiving outgoing mail which is to be picked up by a postal employee. As illustrated, the receptacle 98 is removably received in the receptacle compartment 24' above the incoming mail receptacle 26', and defines an opening 102 for accessing the compartment 100. A closure 104 is pivotally secure to the receptacle 98 adjacent the opening 102 for selectively covering the opening 102.

It will be appreciated that by providing a separate compartment 100 for outgoing mail, the primary closure 50' of the incoming mail compartment 46' can be provided with a lock 106 such that once mail is deposited in the compartment 46' it cannot be removed by unauthorized persons.

It will also be noted that the delivery system 10' is provided with an optional light fixture 94' which is mounted in the sidewall 14' such that a light bulb mounted in the fixture 94' illuminates the house number or other address indicia printed on the side of the delivery system 10'. It will be noted that the light fixture 94 and 94' can be options on either of the delivery systems 10 or 10'.

Figure 15:
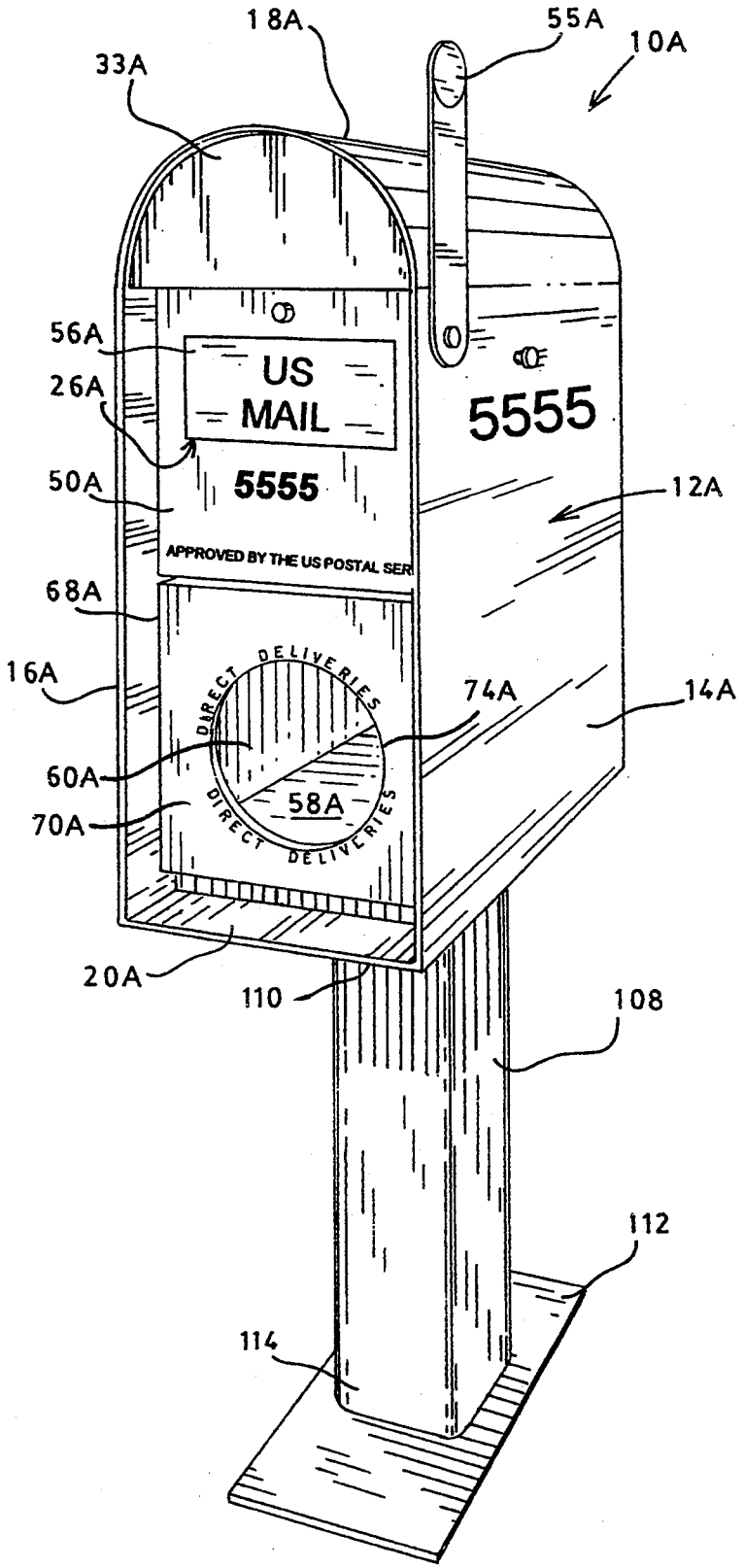
FIG. 15 illustrates a perspective view of a further alternate embodiment of a delivery system of the present invention.

In FIG. 15 a further alternate embodiments of the delivery system of the present invention is illustrated at 10A. For convenience, components of the delivery system 10A which are common to those of the above described delivery system be are referenced in FIG. 15 with common numerals, followed by the alphabetic character "A". It will be noted that the delivery system 10A does not feature a package delivery compartment equivalent to the compartment 76 discussed above. Further, the housing is supported a selected distance above the level of the ground or other supporting surface by a post 108. As illustrated, the post 108 engages the housing 12A at its upper end 110, and can be provided with a base 112 at its lower end 114 if desired. However, it will be understood that the base 112 can be omitted and the lower end 114 can be buried in the ground to effect the securing of the delivery system 10A in the desired erect disposition.

In light of the above it will be recognized that the present invention provides an efficient and cost effective delivery system for receiving mail delivered, and to be delivered, by the United States Postal Service or other governmental postal authority, and for receiving direct delivery items and packages. The system is ideally suited for being positioned at a curbside location, and reduces the time necessary for postal service employees to deliver and collect mail and provide additional package delivery space. Moreover, when properly utilized, the system obviates the improper use of the postal service mail receptacle through the insertion of direct delivery items and provides the opportunity for increased security. However, it will be understood that while a preferred embodiment of the delivery system of the present invention has been shown and described, there is no intent to limit the invention to such disclosure, but rather it is intended to cover all modifications and alternate constructions falling within the spirit and scope of the invention as defined in the appended claims.

I claim:

1. A delivery system for receiving and housing a postal service mail receptacle, and for receiving direct delivery items and packages, said delivery system comprising a housing defining a mail receptacle compartment for receiving and housing said postal service mail receptacle and defining a direct delivery compartment for receiving said direct delivery items, said housing also defining a package delivery compartment for receiving said packages, said package delivery compartment being greater in volume than said direct delivery compartment, said housing including first and second sidewalls, a top wall and a rear wall, said mail receptacle compartment being defined by a portion of said first and second sidewalls, said top wall, a portion of said rear wall, and a first partition which extends between said first and second sidewalls, and wherein said housing is provided with support members for supporting said postal service mail receptacle within said receptacle compartment above and selectively spaced from said first partition.

2. The delivery system of claim 1 wherein said direct delivery compartment is defined by portions of said first and second sidewalls, a portion of said rear wall, said first partition and a second partition extending between said first and second sidewalls, said direct delivery compartment defining a primary access opening for accessing said direct delivery compartment.

3. The delivery system of claim 2 wherein said housing is provided with a first closure pivotally secured to said housing for being selectively received over said primary access opening to at least partially cover said primary access opening, said first closure being provided with a secondary access opening through which said direct delivery items are received.

4. The delivery system of claim 2 wherein said package delivery compartment is defined by portions of said first and second sidewalls, a portion of said rear wall, said second partition, and a third partition extending between said first and second sidewalls, said package delivery compartment defining a primary access opening for accessing said package delivery compartment.

5. The delivery system of claim 3 wherein said package delivery compartment is defined by portions of said first and second sidewalls, a portion of said rear wall, said second partition and a third partition extending between said first and second sidewalls, said package delivery compartment defining an access opening for accessing said package delivery compartment.

6. The delivery system of claim 4 wherein said housing is provided with a second closure pivotally secured to said housing for selectively covering said access opening of said package delivery compartment.

7. The delivery system of claim 5 wherein said housing is provided with a second closure pivotally secured to said housing for selectively covering said access opening of said package delivery compartment.

8. The delivery system of claim 7 wherein said housing is provided with a light fixture disposed above said postal service mail receptacle for illuminating a front portion of said postal service mail receptacle.

9. The delivery system of claim 7 wherein said housing is provided with a light fixture disposed on said first sidewall for illuminating an exterior portion of said first sidewall.

10. The delivery system of claim 1 wherein said postal service mail receptacle includes an incoming mail receptacle for receiving postal service mail delivered by said governmental postal authority and an outgoing mail receptacle for receiving postal service mail to be collected for delivery by said governmental postal authority, said outgoing mail receptacle being received and housed within said housing.

11. The delivery system of claim 10 wherein said incoming mail receptacle defines a primary access opening, and said incoming mail receptacle is provided with a first closure pivotally secured to said incoming mail receptacle for being selectively received over said primary access opening of said incoming mail receptacle to at lease partially cover said primary access opening, said first closure being provided with a lock for securing said first closure and with a secondary access opening through which said postal service mail delivered by said governmental postal authority is received, said first closure being provided with a secondary closure for selectively covering said secondary access opening.

* * * * *